US008657969B2

(12) United States Patent
Kawasaki et al.

(10) Patent No.: US 8,657,969 B2
(45) Date of Patent: Feb. 25, 2014

(54) HIGH-STRENGTH GALVANIZED STEEL SHEET WITH EXCELLENT FORMABILITY AND METHOD FOR MANUFACTURING THE SAME

(75) Inventors: Yoshiyasu Kawasaki, Fukuyama (JP); Tatsuya Nakagaito, Fukuyama (JP); Shinjiro Kaneko, Fukuyama (JP); Saiji Matsuoka, Kurashiki (JP)

(73) Assignee: JFE Steel Corporation (JP)

( * ) Notice: Subject to any disclaimer, the term of this patent is extended or adjusted under 35 U.S.C. 154(b) by 542 days.

(21) Appl. No.: 12/866,481

(22) PCT Filed: Feb. 5, 2009

(86) PCT No.: PCT/JP2009/052353

§ 371 (c)(1), (2), (4) Date: Nov. 1, 2010

(87) PCT Pub. No.: WO2009/099251

PCT Pub. Date: Aug. 13, 2009

(65) Prior Publication Data

US 2011/0036465 A1 Feb. 17, 2011

(30) Foreign Application Priority Data

Feb. 8, 2008 (JP) ..... 2008-029087
Jan. 23, 2009 (JP) ..... 2009-012508

(51) Int. Cl.
*C22C 38/00* (2006.01)

(52) U.S. Cl.
USPC ..... 148/320; 148/331; 148/332; 148/333; 148/334; 148/335; 148/651; 420/83; 420/84; 420/89; 420/90; 420/91; 420/92; 420/93; 428/659

(58) Field of Classification Search
USPC ..... 148/320, 331–335, 651; 420/83–84, 420/89–93, 104–106, 108–109, 119, 121, 420/126–127; 428/659
See application file for complete search history.

(56) References Cited

U.S. PATENT DOCUMENTS

| | | | | |
|---|---|---|---|---|
| 2006/0130937 | A1 * | 6/2006 | Ikeda et al. | 148/320 |
| 2007/0071997 | A1 | 3/2007 | Goto et al. | |
| 2007/0144633 | A1 | 6/2007 | Kizu et al. | |
| 2009/0098408 | A1 | 4/2009 | Sun | |

FOREIGN PATENT DOCUMENTS

| | | | | |
|---|---|---|---|---|
| EP | 148657 | A4 | | 3/2009 |
| JP | 2-097620 | A | | 4/1990 |
| JP | 2-101117 | A | | 4/1990 |
| JP | 4-024418 | B | | 4/1992 |
| JP | 5-072460 | B | | 10/1993 |
| JP | 5-072461 | B | | 10/1993 |
| JP | 5-072462 | B | | 10/1993 |
| JP | 2004211157 | A | * | 7/2004 |
| JP | 2004256836 | A | * | 9/2004 |
| JP | 2006-176807 | A | | 7/2006 |
| JP | 2007-211280 | A | | 8/2007 |
| JP | 2007-262494 | A | | 10/2007 |
| JP | 2008291304 | A | * | 12/2008 |

* cited by examiner

*Primary Examiner* — Sikyin Ip
(74) *Attorney, Agent, or Firm* — DLA Piper LLP (US)

(57) ABSTRACT

A high strength galvanized steel sheet has a TS of 590 MPa or more and excellent processability. The component composition contains, by mass %, C: 0.05% to 0.3%, Si: 0.7% to 2.7%, Mn: 0.5% to 2.8%, P: 0.1% or lower, S: 0.01% or lower, Al: 0.1% or lower, and N: 0.008% or lower, and the balance: Fe or inevitable impurities. The microstructure contains, in terms of area ratio, ferrite phases: 30% to 90%, bainite phases: 3% to 30%, and martensite phases: 5% to 40%, in which, among the martensite phases, martensite phases having an aspect ratio of 3 or more are present in a proportion of 30% or more.

14 Claims, No Drawings

HIGH-STRENGTH GALVANIZED STEEL SHEET WITH EXCELLENT FORMABILITY AND METHOD FOR MANUFACTURING THE SAME

RELATED APPLICATIONS

This is a §371 of International Application No. PCT/JP2009/052353, with an international filing date of Feb. 5, 2009 (WO 2009/099251 A1, published Aug. 13, 2009), which is based on Japanese Patent Application Nos. 2008-029087, filed Feb. 8, 2008, and 2009-012508, filed Jan. 23, 2009, the subject matter of which is incorporated by reference.

TECHNICAL FIELD

This disclosure relates to a high strength galvanized steel sheet excellent in processability suitable as members for use in industrial fields such as the fields of automobiles and electrical components, and a method for manufacturing the same.

BACKGROUND

In recent years, the improvement in fuel efficiency of automobiles has been an important subject from the viewpoint of global environmental conservation. In accordance therewith, there has been a movement towards using materials for automobile bodies of high strength and reduced thickness to lighten automobile bodies. However, an increase in strength of a steel sheet reduces ductility, i.e., reduction in forming processability. Therefore, under the present circumstances, the development of materials having both high strength and processability has been desired.

When a high strength steel sheet is formed into a complicated shape such as that of automotive parts, the development of cracks or necking in a bulged portion or a stretch flange portion poses serious problems. Therefore, a high strength steel sheet having both high ductility and stretch flangeability capable of solving the problem of the development of cracks or necking has also been required.

To improve formability of a high strength steel sheet, various multi phase high strength galvanized steel sheets have been developed to date, such as a ferrite martensite dual-phase steel or TRIP steel utilizing transformation induced plasticity of retained austenite.

For example, JP 4-24418, JP 5-72460, JP 5-72461 and JP 5-72462 disclose steel sheets excellent in stretch flange properties by specifying the chemical compositions and area ratios of bainite and martensite or the average diameter of martensite in a three-phase structure of ferrite, bainite, and martensite.

Moreover, JP 6-70246 and JP 6-70247 disclose steel sheets excellent in ductility by specifying the chemical compositions and heat treatment conditions.

The surface of a steel sheet may be galvanized for the purpose of improving the corrosion resistance in actual use. In that case, to secure press properties, spot welding properties, and paint adhesion, a galvannealed steel sheet in which Fe of the steel sheet has been diffused into a plating layer by heat treatment after plating is frequently used. As such a galvanized steel sheet, JP 2007-211280 discloses a high strength galvanized steel sheet and a high strength galvannealed steel sheet excellent in formability and stretch flangeability and a method for manufacturing the same by specifying the chemical compositions, the volume fractions of ferrite and retained austenite, and the plating layer, for example.

However, in JP 4-24418, JP 5-72460, JP 5-72461 and JP 5-72462, the stretch flangeability is excellent, but the ductility is not sufficient. In JP 6-70246 and JP 6-70247, the ductility is excellent, but the stretch flangeability is not taken into consideration. In JP 2007-211280, the ductility is excellent, but the stretch flangeability is not sufficient.

It could thus be helpful to provide a high strength galvanized steel sheet having a TS of 590 MPa or more and excellent processability and a method for manufacturing the same.

SUMMARY

We conducted extensive research to obtain a high strength galvanized steel sheet having a TS of 590 MPa or more and excellent processability. To obtain a high strength multi phase steel sheet excellent in processability, specifically ductility and stretch flangeability, we conducted extensive research from the viewpoint of a microstructure and a chemical composition of a steel sheet. As a result, we discovered a steel sheet excellent in ductility and further capable of securing sufficient stretch flangeability by increasing ductility through positive addition of Si and increasing stretch flangeability by forming the microstructure of a steel sheet into a multi phase structure containing a ferrite phase, a bainite phase, and martensite (including retained austenite or the like), and controlling the area ratio of each phase. Then, both ductility and stretch flangeability can be achieved, which has been difficult in the past.

Furthermore, we found that not only ductility and stretch flangeability, but also deep drawability increases with the amount, average crystal grain diameter, position, and aspect ratio of the retained austenite phase.

We thus provide:

[1] A high strength galvanized steel sheet excellent in processability, containing:

a component composition, by mass %, of C: 0.05% to 0.3%, Si: 0.7% to 2.7%, Mn: 0.5% to 2.8%, P: 0.1% or lower, S: 0.01% or lower, Al: 0.1% or lower, and N: 0.008% or lower, and a balance: Fe or inevitable impurities, and a microstructure containing, in terms of area ratio, ferrite phases: 30% to 90%, bainite phases: 3% to 30%, and martensite phases: 5% to 40%, among the martensite phases, martensite phases having an aspect ratio of 3 or more being present in a proportion of 30% or more.

[2] The high strength galvanized steel sheet excellent in processability according to [1] above, further containing retained austenite phases in a proportion of 2% or more in terms of volume fraction, wherein the average crystal grain diameter of the retained austenite phases is 2.0 μm or lower.

[3] The high strength galvanized steel sheet excellent in processability according to [1] or [2] above, wherein, among the retained austenite phases, a proportion of retained austenite phases adjacent to the bainite phases is 60% or more and retained austenite phases having an aspect ratio of 3 or more are present in a proportion of 30% or more.

[4] The high strength galvanized steel sheet excellent in processability according to any one of [1] to [3] above, containing at least one element selected from Cr: 0.05% to 1.2%, V: 0.005% to 1.0%, and Mo: 0.005% to 0.5%, by mass %, as a component composition.

[5] The high strength galvanized steel sheet excellent in processability according to any one of [1] to [4] above, containing at least one element selected from Ti: 0.01% to 0.1%, Nb: 0.01% to 0.1%, B: 0.0003% to 0.0050%, Ni: 0.05% to 2.0%, and Cu: 0.05% to 2.0%, by mass %, as a component composition.

[6] The high strength galvanized steel sheet excellent in processability according to any one of [1] to [5] above, containing at least one element selected from Ca: 0.001% to 0.005% and REM: 0.001% to 0.005%, by mass %, as a component composition.

[7] The high strength galvanized steel sheet excellent in processability according to any one of [1] to [6] above, wherein the galvanization is performed by galvannealing.

[8] A method for manufacturing a high strength galvanized steel sheet excellent in processability, including: subjecting a steel slab having the component composition according to any one of [1], [4], [5], and [6] above to hot rolling, pickling, and cold rolling, heating the steel slab to a temperature range of 650° C. or more at an average heating rate of 8° C./s or more, holding the steel slab in a temperature range of 700 to 940° C. for 15 to 600 s, cooling the steel slab to a temperature range of 350 to 500° C. at an average cooling rate of 10 to 200° C./s, holding the steel slab in a temperature range of 350 to 500° C. for 30 to 300 s, and galvanizing the steel slab.

[9] The method for manufacturing a high strength galvanized steel sheet excellent in processability according to [8] above, including galvannealing after the galvanization.

DETAILED DESCRIPTION

In this specification, "%" indicating the steel component is all "mass %." "High strength galvanized steel sheet" refers to a galvanized steel sheet having a tensile strength TS of 590 MPa or more.

Irrespective of whether or not alloying treatment is performed, steel sheets whose surface have been plated with zinc by galvanization are collectively referred to as a "galvanized steel sheet." More specifically, the galvanized steel sheet includes a galvanized steel sheet that has not been alloyed (referred to as "GI steel sheet") and a galvannealed steel sheet that has been alloyed (referred to as "GA steel sheet").

Our steel sheets and methods will be described in detail.

In general, it is known that, in a dual-phase structure of a ferrite phase and a hard martensite phase, ductility can be secured, but sufficient stretch flangeability is not obtained due to a large difference in hardness between the ferrite and martensite phases. Therefore, an attempt to suppress the hardness difference and secure stretch flange properties by defining the ferrite phase as a main phase and defining a bainite phase or a pearlite phase containing carbide as a hard second phase has been made. However, in this case, there has been a problem that sufficient ductility cannot be secured.

We examined the above-described relationship between the volume fraction of the microstructure and mechanical properties. Furthermore, we conducted detailed research focusing on the possibility of improving properties in a multi phase structure containing ferrite phases, bainite phases, and martensite phases (including retained austenite or the like) that is considered to be capable of being manufactured most stably without requiring special facilities.

As a result, the hardness differences at the interfaces between different phases are reduced, and both high ductility and high stretch flangeability can be obtained by positively adding Si for the purpose of strengthening a solid solution of a ferrite phase and processing/hardening of a ferrite phase, forming a multi phase structure of a ferrite phase, a bainite phase, and a martensite phase, and determining the optimum area ratio of the multi phase structure.

The second phase present in a ferrite phase grain boundary promotes crack propagation. Thus, further improvement in stretch flangeability has been attempted by controlling the proportion of each of the martensite phase, the bainite phase, and the retained austenite phase that are present in ferrite phase grains.

The component composition is specified focusing on the Si content (Si: 0.7% to 2.7%) and the microstructure contains, in terms of area ratio, ferrite phases: 30% to 90%, bainite phases: 3% to 30%, and martensite phases: 5% to 40%, and contains martensite phases having an aspect ratio of 3 or more among the martensite phases in a proportion of 30% or more.

1) First, the component composition will be described.

C: 0.05% to 0.3%

C is an austenite generation element and essential to form a multi phase microstructure and increase strength and ductility. When the C content is lower than 0.05%, it is difficult to secure necessary bainite and martensite phases. In contrast, when C is excessively added in amounts exceeding 0.3%, a weld zone and a heat-affected zone are markedly hardened, deteriorating the mechanical properties of the weld zone. Therefore, the C content is adjusted to be 0.05% to 0.3%, with 0.05 to 0.25% being preferable.

Si: 0.7% to 2.7%

Si is a ferrite phase generation element and effective in strengthening a solid solution. Si needs to be added in a proportion of 0.7% or more to improve the balance between strength and ductility and secure the hardness of a ferrite phase. However, excessive addition of Si deteriorates surface quality or adhesion and adhesiveness of coating due to formation of a red scale or the like. Therefore, the Si content is adjusted to be 0.7% to 2.7%, with 1.0% to 2.5% being preferable.

Mn: 0.5% to 2.8%

Mn is an element effective in strengthening steel. Mn is also an element that stabilizes austenite and that is necessary to adjust the volume fraction of the second phase. Hence, Mn needs to be added in a proportion of 0.5% or more. In contrast, when Mn is excessively added in amounts exceeding 2.8%, the volume fraction of the second phase becomes excessively large, making it difficult to secure the volume fraction of a ferrite phase. Therefore, the Mn content is adjusted to be 0.5% to 2.8%, with 1.6% to 2.4% being preferable.

P: 0.1% or lower

P is an element effective in strengthening steel. However, when P is excessively added in amounts exceeding 0.1%, steel embrittlement occurs due to grain boundary segregation, thereby deteriorating the anti-crash property. When the P content exceeds 0.1%, an alloying rate is markedly decreased. Therefore, the P content is adjusted to be 0.1% or lower.

S: 0.01% or lower

The S content is preferably as small as possible because S forms inclusions, such as MnS, causing deterioration of the anti-crash property and formation of cracks along the metal flow portion of a weld zone. The S content is adjusted to be 0.01% or lower from the viewpoint of manufacturing cost.

Al: 0.1% or lower

Excessive addition of Al degrades slab quality when manufacturing steel. Therefore, the Al content is adjusted to be 0.1% or lower.

N: 0.008% or lower

N is an element that markedly deteriorates the age-hardening resistance of steel. Thus, the N content is preferably as small as possible. When the N content exceeds 0.008%, the deterioration of age-hardening resistance becomes noticeable. Therefore, the N content is adjusted to be 0.008% or lower.

The balance is Fe and inevitable impurities. In addition to these constituent elements, the following alloy elements can be added as required.

Cr: 0.05% to 1.2%, V: 0.005% to 1.0%, Mo: 0.005% to 0.5%

Since Cr, V, and Mo act to suppress formation of pearlite when cooling from an annealing temperature, Cr, V, and Mo can be added as required. The effect is induced when the Cr content is 0.05% or more, V is 0.005% or more, and Mo is 0.005% or more. However, when Cr, V, and Mo are added in amounts larger than the amounts: Cr: 1.2%, V: 1.0%, and Mo: 0.5%, respectively, the volume fraction of the second phase becomes excessively large, giving rise to concerns about the marked increase in strength. Moreover, excessive addition thereof becomes a cost factor. Therefore, when these elements are added, the content of each element is adjusted as follows: Cr: 1.2% or lower, V: 1.0% or lower, and Mo: 0.5% or lower.

Furthermore, at least one element of the following elements: Ti, Nb, B, Ni, and Cu, can be added.

Ti: 0.01% to 0.1%, Nb: 0.01% to 0.1%

Ti and Nb are effective in strengthening precipitation of steel. The effect is induced when the content of each of Ti and Nb is 0.01% or more. Ti and Nb may be used for strengthening steel when used in the specified ranges. However, when the content of each element exceeds 0.1%, processability and shape fixability decrease. Moreover, excessive addition thereof becomes a cost factor. Therefore, when Ti and Nb are added, the addition amount of Ti is adjusted to be 0.01% to 0.1% and the addition amount of Nb is adjusted to be 0.01% to 0.1%.

B: 0.0003% to 0.0050%

Since B acts to suppress formation and growth of a ferrite phase from austenite grain boundaries, B can be added as required. The effect is induced when the B content is 0.0003% or more. However, when the content thereof exceeds 0.0050%, processability decreases. Moreover, the excessive addition thereof becomes a cost factor. Therefore, when B is added, the addition amount of B is adjusted to be 0.0003% to 0.0050%.

Ni: 0.05% to 2.0%, Cu: 0.05% to 2.0%

Ni and Cu are elements effective in strengthening steel, and may be used for strengthening steel insofar as they are used in the specified ranges. Ni and Cu promote internal oxidation to thereby increase adhesion of coatings. The content of each of Ni and Cu needs to be 0.05% or more to obtain these effects. In contrast, when Ni and Cu are added in amounts exceeding 2.0%, processability of the steel sheet decreases. Moreover, an excessive addition thereof becomes a cost factor. Therefore, when Ni and Cu are added, the addition amount of each of Ni and Cu is adjusted to be 0.05% to 2.0%.

Ca: 0.001% to 0.005%, REM: 0.001% to 0.005%

Ca and REM are elements effective in forming the shape of sulfide into a spherical shape and reducing adverse effects of sulfide on stretch flange properties. The content of each of Ca and REM needs to be 0.001% or more to obtain the effects. However, excessive addition of Ca and REM increases an inclusion content or the like, causing surface defects, internal defects and the like. Therefore, when Ca and REM are added, the addition amount of each of Ca and REM is adjusted to be 0.001% to 0.005%.

2) Next, the microstructure will be described.

Ferrite-Phase Area Ratio: 30% to 90%

Ferrite phases need to be 30% or more in terms of area ratio to secure favorable ductility. In contrast, to secure strength, the area ratio of soft ferrite phases needs to be 90% or lower.

Bainite-Phase Area Ratio: 3% to 30%

A bainite phase that buffers the hardness difference between a ferrite phase and a martensite phase needs to be 3% or more in terms of area ratio to secure favorable stretch flangeability. In contrast, to secure favorable ductility, the area ratio of bainite phases is adjusted to be 30% or lower.

Martensite-Phase Area Ratio: 5% to 40%

The martensite phases need to be 5% or more in terms of area ratio to secure strength and promote a processing effect of ferrite phases. Moreover, to secure ductility and stretch flangeability, the area ratio of martensite phases is adjusted to be 40% or lower.

Presence of 30% or more of martensite phases having an aspect ratio of 3 or more among martensite phases.

The martensite phase having an aspect ratio of 3 or more as used herein refers to a martensite phase generated in a cooling process after holding in a temperature range of 350 to 500° C. for 30 to 300 s, and galvanizing. When the martensite phases are classified according to shape, the martensite phases are classified into a massive martensite phase having an aspect ratio lower than 3, or a needle-like martensite phase, or a plate-like martensite phase each having an aspect ratio of 3 or more. A large number of bainite phases are present in the vicinity of the needle-like martensite phase and the plate-like martensite phase each having an aspect ratio of 3 or more compared with the massive martensite phases having an aspect ratio lower than 3. The stretch flangeability increases when the bainite phase serves as a buffer material that reduces hardness differences between the needle-like martensite phase and the plate-like martensite phase and the ferrite phase.

The area ratio of the ferrite phases, the bainite phases, and the martensite phases refers to area ratios of the respective phases in an observed area. The above-described respective area ratios, the aspect ratios (long side/short side) of the martensite phases, and the area ratio of the martensite phases having an aspect ratio of 3 or more among the martensite phases can be determined using Image-Pro of Media Cybernetics by polishing a through-thickness section parallel to the rolling direction of a steel sheet, corroding the section with 3% naital, and observing 10 visual fields at a magnification of ×2000 using SEM (Scanning Electron Microscope).

Retained Austenite Phase Volume Fraction: 2% or More

To secure favorable ductility and deep drawability, retained austenite phases are preferably 2% or more in terms of volume fraction.

Average Crystal Grain Diameter of Retained Austenite Phase: 2.0 μm or Lower

When the average crystal grain diameter of retained austenite phases exceeds 2.0 μm, the grain boundary area (amount of an interface between different phases) of the retained austenite phases increases. More specifically, the proportion of interfaces having a large hardness difference increases, thereby resulting in reduced stretch flangeability. Therefore, in order to secure more favorable stretch flangeability, the average crystal grain diameter of retained austenite phases is preferably 2.0 μm or lower to secure more favorable stretch flangeability.

60% or More of Retained Austenite Phases Adjacent to Bainite Phases Among Retained Austenite Phases.

The bainite phases are softer than hard retained austenite or martensite phases and are harder than soft ferrite phases. Therefore, the bainite phases act as an intermediate phase (buffer material), and reduces hardness differences between different phases (a hard retained austenite phase or martensite phase and a soft ferrite phase) to increase stretch flangeability. The retained austenite phases adjacent to the bainite phases among the retained austenite phases are preferably present in a proportion of 60% or more to secure favorable stretch flangeability.

30% or More of Retained Austenite Phases Having an Aspect Ratio of 3 or More Among Retained Austenite Phases The retained austenite phases having an aspect ratio of 3 or more as used herein refers to retained austenite phases having a high dissolution carbon content, the dissolution carbon which is generated when bainite transformation is accelerated by holding in a temperature range of 350 to 500° C. for 30 to 300 s, and carbon is diffused into an untransformed austenite side. The retained austenite phases having a high dissolution carbon content have high stability. When the proportion of the retained austenite phases is high, ductility and deep drawability increase. When the retained austenite phases are classified according to shape, the retained austenite phases are classified into a massive retained austenite phase having an aspect ratio lower than 3, or a needle-like retained austenite phase, or a plate-like retained austenite phase each having an aspect ratio of 3 or more. A large number of bainite phases are present in the vicinity of the needle-like retained austenite phase and the plate-like retained austenite phase each having an aspect ratio of 3 or more compared with the massive retained austenite phase having an aspect ratio lower than 3.

The stretch flangeability increases when the bainite phase serves as a buffer material that reduces hardness differences between the needle-like retained austenite phase and the plate-like retained austenite phase and ferrite. Therefore, in order the proportion of the retained austenite phases having an aspect ratio of 3 or more among the retained austenite phases is preferably adjusted to 30% or more to secure favorable stretch flangeability.

The retained austenite phase volume factor can be determined by polishing a steel sheet to a ¼ depth plane in the sheet thickness direction, and calculating the diffraction X-ray intensity of the ¼ depth plane. MoKα rays are used as incident X-ray, and an intensity ratio is calculated for all combinations of the integrated intensities of the peaks of {111}, {200}, {220}, and {311} planes of the retained austenite phase and {110}, {200}, and {211} planes of the ferrite phase. Then, the average value thereof is used as the volume factor of the retained austenite.

The average crystal grain diameter of the retained austenite phases can be determined using TEM (transmission electron microscope) by observing 10 or more retained austenite phases, and averaging the crystal grain diameters.

The proportions of the retained austenite phases adjacent to the bainite phases and the retained austenite phases having an aspect ratio of 3 or more can be determined using Image-Pro of Media Cybernetics by polishing a through-thickness section parallel to the rolling direction of a steel sheet, corroding the resultant with 3% nital, and observing 10 visual fields at a magnification of ×2000 using SEM (Scanning Electron Microscope). The area ratio is obtained by the above-described method, and the obtained value is used as the volume factor. At that time, when the retained austenite phases and the martensite phases are observed by SEM after etching by nital corrosion solution, both of them are observed as white phases, and cannot be distinguished from each other. Thus, heat treatment (200° C.×2 h) is performed to temper only martensite, whereby the retained austenite phases and the martensite phases can be distinguished from each other.

In addition to the ferrite phase, the martensite phase, the bainite phase, and the retained austenite phase, a pearlite phase, or carbide, such as cementite, can be introduced. In this case, from the viewpoint of stretch flange properties, the area ratio of the pearlite phase is preferably 3% or lower.

3) Next, manufacturing conditions will be described.

The high strength galvanized steel sheet can be manufactured by hot-rolling, pickling, and cold-rolling a steel sheet having the above-described component composition, heating the steel sheet to a temperature range of 650° C. or more at an average heating rate of 8° C./s or more, holding the steel sheet at a temperature range of 700 to 940° C. for 15 to 600 s, cooling the steel sheet to a temperature range of 350 to 500° C. at an average cooling rate of 10 to 200° C./s, holding the steel sheet at a temperature range of 350 to 500° C. for 30 to 300 s, and galvanizing the steel sheet. Hereinafter, the details will be described.

A steel having the above-described component composition is melted, formed into a slab through cogging or continuous casting, and then formed into a hot coil through hot rolling by a known process. When hot rolling is performed, the slab is heated to 1100 to 1300° C., subjected to hot rolling at a final finishing temperature of 850° C. or more, and wound around a steel strip at 400 to 750° C. When the winding temperature exceeds 750° C., carbide in a hot-rolled sheet becomes coarse, and such coarse carbide does not completely melt during soaking at the time of short-time annealing after cold-rolling. Thus, necessary strength cannot be obtained in some cases.

Thereafter, the resulting steel sheet is subjected to preliminary treatment such as pickling or degreasing, and then subjected to cold-rolling by a known method. The cold-rolling is preferably performed at a cold rolling reduction of 30% or more. When the cold rolling reduction is low, the recrystallization of a ferrite phase may not be promoted, an unrecrystallized ferrite phase may remain, and ductility and stretch flangeability may decrease in some cases. Heating to a temperature range of 650° C. or more at an average heating rate of 8° C./s or more When the heating temperature range is lower than 650° C., an austenite phase that is finely and uniformly dispersed is not generated and a microstructure in which the area ratio of martensite phases having an aspect ratio of 3 or more among martensite phases of the final structure is 30% or more is not obtained, thereby resulting in a failure of obtaining necessary stretch flangeability. When the average heating rate is lower than 8° C./s, a furnace longer than usual is required. This increases the cost and deteriorates production efficiency accompanied with high energy consumption. It is preferable to use DFF (Direct Fired Furnace) as the heating furnace. This is because an internal oxidation layer is formed by rapid heating by DFF, and concentration of oxides, such as Si or Mn, to the top surface layer of a steel sheet is prevented, thereby securing favorable plating properties.

Holding in a Temperature Range of 700 to 940° C. for 15 to 600 s

Annealing (holding) is carried out for 15 to 600 s in a temperature range of 700 to 940° C., specifically an austenite single phase region or a two-phase region of an austenite phase and a ferrite phase. When an annealing temperature is lower than 700° C. or when a holding (annealing) time is shorter than 15 s, hard cementite in a steel sheet does not sufficiently dissolve in some cases or the recrystallization of a ferrite phase is not completed, and the target structure is not obtained, thereby resulting in insufficient strength in some cases. In contrast, when the annealing temperature exceeds 940° C., austenite grain growth is noticeable, which sometimes reduces nucleation sites of ferrite phases from a second phase generated in the following cooling process. When the holding (annealing) time exceeds 600 s, austenite becomes coarse and the cost increases accompanied with high energy expenditure in some cases.

Cooling to a Temperature Range of 350 to 500° C. at an Average Cooling Rate of 10 to 200° C./s This quenching is an important requirement. By quenching to a temperature range of 350 to 500° C. that is a bainite phase generation temperature range, formation of cementite and pearlite from austenite in the middle of cooling can be suppressed to increase driving force of bainite transformation. When an average cooling rate is lower than 10° C./s, pearlite or the like precipitates and ductility decreases. When an average cooling rate exceeds 200° C./s, precipitation of ferrite phases is insufficient, a microstructure in which a second phase is uniformly and finely dispersed in a ferrite phase base is not obtained, and stretch flangeability decreases. This also leads to deterioration of the steel sheet shape.

Holding in a Temperature Range of 350 to 500° C. for 30 to 300 s

Holding in this temperature range is an important requirements. When the holding temperature is lower than 350° C. or exceeds 500° C. and when the holding time is shorter than 30 s, bainite transformation is not promoted, a microstructure in which the area ratio of martensite phases having an aspect ratio of 3 or more among the martensite phases of the final structure is 30% or more is not obtained and, thus, necessary stretch flangeability is not obtained. Since a two phase structure of a ferrite and martensite phase is formed, the hardness difference between the two phases becomes large and necessary stretch flangeability is not obtained. When the holding time exceeds 300 s, a second phase is almost bainited and, thus, the area ratio of martensite phases becomes lower than 5%, and hardness becomes difficult to secure.

Galvanization Treatment

The surface of the steel sheet is subjected to galvanization treatment to improve corrosion resistance in actual use. The galvanization treatment is performed by immersing a steel sheet in a plating bath having a usual bath temperature, and adjusting the coating weight by gas wiping or the like. It is unnecessary to limit the conditions of the plating bath temperature, and the temperature is preferably in the range of 450 to 500° C.

To secure press properties, spot welding properties, and paint adhesion, a galvannealed steel sheet in which Fe of the steel sheet is diffused into a plating layer by performing heat treatment after plating is frequently used.

In a series of heat treatment in the manufacturing method, the holding temperature needs not be constant insofar as the holding temperature is in the above-mentioned temperature ranges. Even when the cooling rate changes during cooling, the scope of the steel sheet is not be impaired insofar as the change is in the specified ranges. A steel sheet may be heat treated by any facilities insofar as only a thermal hysteresis is satisfied. In addition, temper rolling for shape straightening of the steel sheet after heat treatment is also possible. Although, in the case where a steel material is manufactured through the respective processes of usual steel manufacturing, casting, and hot-rolling is assumed, the case where a steel material is manufactured by thin slab caster while omitting some or all of the hot-rolling process is acceptable.

EXAMPLES

Steels having a component composition shown in Table 1 were melted in a vacuum melting furnace, roughly rolled to a sheet thickness of 35 mm, held while heating at 1100 to 1300° C. for 1 h, rolled to a sheet thickness of about 4.0 mm at a finish rolling temperature of 850° C. or more, held at 400 to 750° C. for 1 h, and then cooled in a furnace.

Subsequently, the obtained hot-rolled sheets were subjected to pickling, and then cold-rolled to a sheet thickness of 1.2 mm.

Subsequently, the cold-rolled steel sheets obtained above were heated, held, cooled, and held under the manufacturing conditions shown in Table 2, and then subjected to galvanization treatment, thereby obtaining GI steel sheets. Some of the steel sheets were subjected to galvannealing treatment further including heat treatment at 470 to 600° C. after the galvanization treatment, thereby obtaining GA steel sheets.

The galvanized steel sheets (GI steel sheet and GA steel sheet) obtained above were examined for cross-sectional microstructure, tensile characteristics, stretch flange properties, and deep drawability.

<Cross-Sectional Microstructure>

A picture of the cross-sectional microstructure of each steel sheet was taken with a scanning electron microscope at a suitable magnification of 1000 to 3000 times in accordance with the fineness of the microstructure at the ¼ depth position of the sheet thickness in the depth direction after the microstructure was made to appear with a 3% nital solution (3% nitric acid and ethanol). Then, the area ratios of the ferrite phases, the bainite phases, and the martensite phases were quantitatively calculated using Image-Pro of Media Cybernetics that is a commercially available image analysis software.

The volume fraction of retained austenite phases was obtained by polishing the steel sheet to the ¼ depth plane in the sheet thickness direction, and calculating the diffraction X-ray intensity of the ¼ depth plane of the sheet thickness. MoKα rays were used as incident X-ray, and an intensity ratio was calculated for all combinations of the integrated intensities of the peaks of {111}, {200}, {220}, and {311} planes of the retained austenite phase and {110}, {200}, and {211} planes of the ferrite phase. Then, the average value thereof was used as the volume fraction of the retained austenite.

The average crystal grain diameter of the retained austenite phases was determined as follows. The area of the retained austenite of arbitrarily selected grains was determined using a transmission electron microscope, the length of one piece when converted into a square was defined as the crystal grain diameter of the grain, the length was obtained for ten grains, and the average value thereof was defined as the average crystal grain diameter of the retained austenite phase of the steel.

<Tensile Characteristics>

A tensile test was performed to determine TS (tensile strength) and El (total elongation).

The tensile test was performed for test pieces processed into JIS No. 5 test piece according to JIS Z2241. The following cases were judged to be excellent: El≥28(%) in a tensile strength of 590 MPa class, El≥21(%) in a tensile strength of 780 MPa class, and El≥15(%) in a tensile strength of 980 MPa class.

<Stretch Flange Properties>

The stretch flange properties were evaluated based on Japan Iron and Steel Federation standard practice JFST1001. Each of the obtained steel sheets was cut into 100 mm×100 mm, and a hole 10 mm in diameter was punched at a clearance of 12%. Then, in a state where each steel sheet was pressed at a blank holding force of 9 t using a die having an inner diameter of 75 mm, a 60° conical punch was pressed into the hole, and then the hole diameter at a crack formation limit was measured. Then, from the following equation, the limiting stretch flangeability λ (%) was determined, and the stretch flange properties were evaluated based on the limiting stretch flangeability λ (%).

$$\text{Limiting stretch flangeability } \lambda(\%)=\{(D_f-D_0)/D_0\}\times 100$$

$D_f$ represents a hole diameter (mm) at the time of crack formation and $D_0$ represents an initial hole diameter (mm).

The following cases were judged to be excellent: λ≥70(%) in a tensile strength of 590 MPa class, λ≥60(%) in a tensile strength of 780 MPa class, and λ≥50(%) in a tensile strength of 980 MPa class.

<Description of r Value>

An r value was determined as follows. No. 5 test pieces of JISZ2201 were cut out from a cold rolled annealed sheet in each of L direction (rolling direction), D direction (direction at an angle 45° to the rolling direction), and C direction (direction at an angle 90° to the rolling direction), $r_L$, $r_D$, and $r_C$ of each of the test pieces were determined according to the regulations of JISZ2254, and then the r value was calculated by Equation (1):

$$r = \frac{r_L + 2r_D + r_C}{4}. \quad (1)$$

<Deep Drawability>

A deep-draw-forming test was performed by a cylindrical drawing test, and the deep drawability was evaluated by a limiting drawing ratio (LDR). The conditions of the cylindrical drawing test were as follows. For the test, a cylindrical punch 33 mmϕ in diameter and a die 36.6 mm in diameter were used. The test was performed at a blank holding force of 1 t and a forming rate of 1 mm/s. The surface sliding conditions change according to plating conditions or the like. Thus, the test was performed under high lubrication conditions by placing a polyethylene sheet between a sample and the die so that the surface sliding conditions do not affect the test. The blank diameter was changed at 1 mm pitch, and a ratio (D/d) of the blank diameter D to the punch diameter d that was drawn through the die without fracture was determined as the LDR. The results obtained above are shown in Table 3.

All of the high strength galvanized steel sheets of our examples have a TS of 590 MPa or more and are excellent in stretch and stretch flange properties. The high strength galvanized steel sheets of our examples satisfy TS×El≥16000 MPa·%, which shows that they are high strength galvanized steel sheets having an excellent balance between hardness and ductility and excellent processability.

Furthermore, our steel sheets satisfying the volume factor, the average crystal grain diameter and the like of retained austenite phases have an LDR as high as 2.09 or more, and exhibit an excellent deep drawability. In contrast, in the Comparative Examples, at least one of hardness, elongation, and stretch flange properties is poor.

INDUSTRIAL APPLICABILITY

A high strength galvanized steel sheet having a TS of 590 MPa or more, and is excellent in processability is obtained. When the steel sheet is applied to automobile structural members, the car body weight can be reduced, thereby achieving improved fuel consumption. The industrial utility value is noticeably high.

TABLE 1

| Steel | Chemical composition (mass %) | | | | | | | | | | | | | | | | | |
|---|---|---|---|---|---|---|---|---|---|---|---|---|---|---|---|---|---|---|
| type | C | Si | Mn | Al | P | S | N | Ni | Cu | Cr | V | Mo | Nb | Ti | B | Ca | REM | Remarks |
| A | 0.079 | 1.52 | 2.01 | 0.039 | 0.009 | 0.005 | 0.0036 | — | — | — | — | — | — | — | — | — | — | Present example |
| B | 0.101 | 1.02 | 1.75 | 0.037 | 0.011 | 0.004 | 0.0035 | — | — | — | — | — | — | — | — | — | — | Present example |
| C | 0.092 | 2.12 | 1.42 | 0.039 | 0.010 | 0.004 | 0.0040 | — | — | — | — | — | — | — | — | — | — | Present example |
| D | 0.113 | 1.86 | 2.24 | 0.039 | 0.010 | 0.004 | 0.0040 | — | — | — | — | — | — | — | — | — | — | Present example |
| E | 0.002 | 1.51 | 2.06 | 0.041 | 0.026 | 0.003 | 0.0038 | — | — | — | — | — | — | — | — | — | — | Comparative example |
| F | 0.312 | 1.53 | 1.98 | 0.038 | 0.021 | 0.002 | 0.0041 | — | — | — | — | — | — | — | — | — | — | Comparative example |
| G | 0.078 | 0.30 | 2.04 | 0.044 | 0.011 | 0.005 | 0.0032 | — | — | — | — | — | — | — | — | — | — | Comparative example |
| H | 0.083 | 3.02 | 1.99 | 0.042 | 0.023 | 0.002 | 0.0039 | — | — | — | — | — | — | — | — | — | — | Comparative example |
| I | 0.085 | 1.50 | 0.30 | 0.038 | 0.011 | 0.004 | 0.0036 | — | — | — | — | — | — | — | — | — | — | Comparative example |
| J | 0.079 | 1.55 | 3.21 | 0.036 | 0.012 | 0.003 | 0.0038 | — | — | — | — | — | — | — | — | — | — | Comparative example |
| K | 0.081 | 1.52 | 2.02 | 0.040 | 0.012 | 0.002 | 0.0039 | — | — | 0.23 | — | — | — | — | — | — | — | Present example |
| L | 0.079 | 1.06 | 2.08 | 0.041 | 0.012 | 0.004 | 0.0032 | — | — | — | 0.081 | 0.048 | — | — | — | — | — | Present example |
| M | 0.070 | 1.42 | 2.01 | 0.037 | 0.010 | 0.002 | 0.0041 | — | — | — | — | — | 0.039 | 0.021 | — | — | — | Present example |
| N | 0.088 | 1.09 | 2.31 | 0.040 | 0.012 | 0.003 | 0.0041 | — | — | — | — | — | — | 0.020 | 0.0012 | — | — | Present example |
| O | 0.090 | 1.51 | 1.88 | 0.039 | 0.011 | 0.004 | 0.0037 | 0.11 | 0.10 | — | — | — | — | — | — | — | — | Present example |
| P | 0.118 | 1.68 | 2.22 | 0.040 | 0.011 | 0.003 | 0.0035 | — | — | — | — | — | — | — | — | 0.003 | — | Present example |
| Q | 0.102 | 1.84 | 2.34 | 0.038 | 0.012 | 0.004 | 0.0041 | — | — | — | — | — | — | — | — | — | 0.002 | Present example |

TABLE 1-continued

| Steel type | Chemical composition (mass %) C | Si | Mn | Al | P | S | N | Ni | Cu | Cr | V | Mo | Nb | Ti | B | Ca | REM | Remarks |
|---|---|---|---|---|---|---|---|---|---|---|---|---|---|---|---|---|---|---|
| R | 0.083 | 1.52 | 1.39 | 0.031 | 0.009 | 0.0014 | 0.0031 | — | — | — | — | — | — | — | — | — | — | Present example |
| S | 0.079 | 1.46 | 1.28 | 0.030 | 0.018 | 0.0029 | 0.0032 | — | — | 0.13 | — | — | — | — | — | — | — | Present example |
| T | 0.091 | 1.45 | 1.31 | 0.032 | 0.010 | 0.0034 | 0.0032 | — | — | — | — | — | — | 0.021 | 0.0015 | — | — | Present example |

Underlined portion: Outside the scope of the invention

TABLE 2

| No. | Steel type | Heating stop temperature ° C. | Average heating rate to a temperature range of 650° C. or more ° C./s | Annealing temperature ° C. | Annealing time s | Average cooling rate to a temperature range of 350 to 500° C. ° C./s | Holding temperature ° C. | Holding time s | Remarks |
|---|---|---|---|---|---|---|---|---|---|
| 1 | A | 750 | 12 | 850 | 200 | 80 | 400 | 100 | Present example |
| 2 | A | 500 | 4 | 860 | 180 | 70 | 410 | 80 | Comparative example |
| 3 | A | 750 | 13 | 610 | 230 | 75 | 500 | 110 | Comparative example |
| 4 | A | 760 | 11 | 990 | 230 | 60 | 500 | 90 | Comparative example |
| 5 | B | 760 | 14 | 870 | 180 | 75 | 400 | 90 | Present example |
| 6 | B | 730 | 10 | 820 | 5 | 80 | 450 | 160 | Comparative example |
| 7 | B | 720 | 11 | 860 | 700 | 90 | 420 | 90 | Comparative example |
| 8 | B | 740 | 13 | 830 | 200 | 3 | 380 | 70 | Comparative example |
| 9 | B | 750 | 10 | 850 | 160 | 220 | 400 | 80 | Comparative example |
| 10 | C | 820 | 11 | 900 | 210 | 80 | 390 | 120 | Present example |
| 11 | C | 830 | 11 | 870 | 180 | 90 | 280 | 70 | Comparative example |
| 12 | C | 790 | 13 | 810 | 195 | 80 | 600 | 120 | Comparative example |
| 13 | D | 720 | 12 | 840 | 190 | 70 | 410 | 130 | Present example |
| 14 | D | 730 | 11 | 860 | 180 | 65 | 460 | 5 | Comparative example |
| 15 | D | 710 | 14 | 820 | 150 | 70 | 410 | 500 | Comparative example |
| 16 | E | 760 | 15 | 790 | 210 | 95 | 400 | 70 | Comparative example |
| 17 | F | 750 | 12 | 840 | 200 | 80 | 410 | 90 | Comparative example |
| 18 | G | 690 | 9 | 780 | 180 | 85 | 430 | 80 | Comparative example |
| 19 | H | 790 | 11 | 810 | 210 | 70 | 380 | 120 | Comparative example |
| 20 | I | 750 | 12 | 820 | 170 | 70 | 410 | 90 | Comparative example |
| 21 | J | 760 | 10 | 850 | 180 | 75 | 420 | 110 | Comparative example |
| 22 | K | 740 | 13 | 830 | 180 | 70 | 420 | 90 | Present example |
| 23 | L | 690 | 10 | 820 | 160 | 85 | 400 | 100 | Present example |
| 24 | M | 760 | 12 | 850 | 190 | 75 | 390 | 120 | Present example |
| 25 | N | 700 | 11 | 810 | 180 | 70 | 410 | 90 | Present example |
| 26 | O | 770 | 15 | 860 | 170 | 90 | 400 | 80 | Present example |
| 27 | P | 680 | 10 | 820 | 200 | 80 | 430 | 90 | Present example |

TABLE 2-continued

| No. | Steel type | Heating stop temperature ° C. | Average heating rate to a temperature range of 650° C. or more ° C./s | Annealing temperature ° C. | Annealing time s | Average cooling rate to a temperature range of 350 to 500° C. ° C./s | Holding temperature ° C. | Holding time s | Remarks |
|---|---|---|---|---|---|---|---|---|---|
| 28 | Q | 730 | 13 | 850 | 180 | 90 | 400 | 110 | Present example |
| 29 | A | 750 | 12 | 850 | 200 | 100 | 400 | 200 | Present example |
| 30 | C | 820 | 11 | 900 | 210 | 130 | 390 | 160 | Present example |
| 31 | O | 770 | 15 | 860 | 170 | 120 | 400 | 130 | Present example |
| 32 | R | 745 | 11 | 845 | 180 | 15 | 400 | 50 | Present example |
| 33 | R | 750 | 12 | 850 | 200 | 30 | 410 | 70 | Present example |
| 34 | R | 755 | 10 | 840 | 210 | 90 | 405 | 60 | Present example |
| 35 | S | 750 | 11 | 850 | 180 | 25 | 480 | 60 | Present example |
| 36 | S | 755 | 12 | 840 | 200 | 20 | 440 | 50 | Present example |
| 37 | S | 760 | 14 | 870 | 180 | 30 | 400 | 60 | Present example |
| 38 | T | 740 | 15 | 840 | 160 | 25 | 415 | 60 | Present example |
| 39 | T | 755 | 12 | 850 | 200 | 30 | 400 | 120 | Present example |
| 40 | T | 730 | 10 | 820 | 150 | 20 | 410 | 180 | Present example |

Underlined portion: Outside the scope of the invention

TABLE 3

| No. | Steel type | Plating type | Ferrite phase area ratio (%) | Bainite phase area ratio (%) | Martensite phase area ratio (%) | Volume fraction of retained austenite phase (%) | Average crystal grain diameter of retained austenite phase (μm) | Area ratio of martensite phase having an aspect ratio of 3 or more among martensite phases (%) | Proportion of retained austenite phase adjacent to bainite phase among retained austenite phases (%) |
|---|---|---|---|---|---|---|---|---|---|
| 1 | A | GA | 78.6 | 11.6 | 9.8 | 3.8 | 1.3 | 52 | 65 |
| 2 | A | GI | 76.6 | 12.6 | 10.8 | 2.8 | 1.2 | 18 | 63 |
| 3 | A | GA | 79.2 | 10.1 | 4.1 | 3.1 | 0.9 | 36 | 26 |
| 4 | A | GI | 27.3 | 41.6 | 31.1 | 1.6 | 1.4 | 42 | 43 |
| 5 | B | GI | 72.1 | 11.7 | 16.2 | 4.9 | 0.9 | 48 | 76 |
| 6 | B | GA | 86.6 | 9.6 | 3.8 | 2.4 | 0.8 | 42 | 22 |
| 7 | B | GI | 37.6 | 13.1 | 49.3 | 1.0 | 3.8 | 40 | 50 |
| 8 | B | GA | 73 | 6.1 | 2.2 | 0.8 | 0.5 | 68 | 19 |
| 9 | B | GA | 18.8 | 33.1 | 48.1 | 1.7 | 4.5 | 48 | 52 |
| 10 | C | GA | 71.6 | 14.6 | 13.8 | 5.1 | 0.9 | 59 | 66 |
| 11 | C | GA | 59.9 | 1.6 | 38.5 | 0.4 | 3.5 | 22 | 14 |
| 12 | C | GA | 78.1 | 0.9 | 10.8 | 0.2 | 0.9 | 14 | 19 |
| 13 | D | GI | 64.2 | 15.2 | 20.6 | 3.9 | 1.6 | 61 | 73 |
| 14 | D | GA | 48.2 | 8.7 | 43.1 | 0.3 | 0.6 | 25 | 11 |
| 15 | D | GI | 49.6 | 48.3 | 2.1 | 5.6 | 0.9 | 54 | 55 |
| 16 | E | GA | 96.2 | 2.7 | 1.1 | 0.2 | 0.3 | 44 | 5 |
| 17 | F | GA | 24.8 | 37.2 | 38.0 | 3.1 | 4.9 | 63 | 48 |
| 18 | G | GI | 43.6 | 46.2 | 10.2 | 2.7 | 0.8 | 41 | 32 |
| 19 | H | GA | 91.8 | 4.9 | 3.3 | 1.1 | 0.6 | 42 | 55 |
| 20 | I | GI | 92.5 | 5.3 | 2.2 | 0.6 | 0.4 | 65 | 21 |
| 21 | J | GA | 68.3 | 0.6 | 31.1 | 0.1 | 0.2 | 9 | 6 |
| 22 | K | GA | 84.6 | 6.5 | 8.9 | 3.4 | 0.9 | 46 | 68 |
| 23 | L | GI | 81.2 | 8.6 | 10.2 | 3.8 | 1.0 | 58 | 74 |
| 24 | M | GI | 82.4 | 9.4 | 8.2 | 3.9 | 0.8 | 42 | 69 |
| 25 | N | GA | 72.2 | 14.6 | 13.2 | 4.8 | 0.9 | 61 | 76 |
| 26 | O | GA | 73.8 | 12.1 | 14.1 | 4.1 | 0.7 | 45 | 78 |

TABLE 3-continued

| | | | | | | | | | |
|---|---|---|---|---|---|---|---|---|---|
| 27 | P | GI | 67.1 | 11.8 | 21.1 | 3.2 | 0.9 | 56 | 72 |
| 28 | Q | GA | 66.1 | 11.3 | 22.6 | 3.5 | 1.0 | 39 | 68 |
| 29 | A | GA | 77.8 | 13.1 | 5.9 | 6.7 | 0.8 | 52 | 77 |
| 30 | C | GA | 72.8 | 15.8 | 6.2 | 10.2 | 0.6 | 59 | 81 |
| 31 | O | GA | 75.0 | 14.9 | 6.0 | 9.2 | 0.9 | 45 | 76 |
| 32 | R | GA | 79.2 | 9.8 | 5.7 | 6.2 | 1.2 | 51 | 69 |
| 33 | R | GI | 81.1 | 12.2 | 5.1 | 5.7 | 1.0 | 53 | 78 |
| 34 | R | GA | 77.4 | 14.3 | 5.2 | 6.1 | 0.8 | 58 | 84 |
| 35 | S | GA | 79.0 | 5.1 | 6.0 | 6.8 | 1.3 | 62 | 68 |
| 36 | S | GA | 82.1 | 9.7 | 6.8 | 6.5 | 0.9 | 67 | 76 |
| 37 | S | GA | 78.2 | 13.8 | 6.9 | 5.5 | 0.8 | 77 | 81 |
| 38 | T | GA | 81.3 | 10.2 | 5.2 | 7.8 | 1.4 | 42 | 72 |
| 39 | T | GI | 78.8 | 13.4 | 5.4 | 6.0 | 1.1 | 56 | 75 |
| 40 | T | GA | 79.2 | 12.8 | 6.1 | 5.8 | 0.8 | 80 | 80 |

| No. | Volume fraction of retained austenite phase having an aspect ratio of 3 or more among retained austenite phases (%) | TS (MPa) | El (%) | λ (%) | TS × El (MPa · %) | r value | LDR | Remarks |
|---|---|---|---|---|---|---|---|---|
| 1 | 41 | 631 | 32.7 | 97 | 20634 | 1.01 | 2.12 | Present example |
| 2 | 22 | 610 | 31.1 | 65 | 18971 | 1.00 | 2.06 | Comparative example |
| 3 | 11 | 568 | 32.5 | 72 | 18460 | 0.99 | 2.06 | Comparative example |
| 4 | 18 | 969 | 10.8 | 71 | 10465 | 1.01 | 2.00 | Comparative example |
| 5 | 45 | 791 | 24.6 | 72 | 19459 | 1.03 | 2.12 | Present example |
| 6 | 17 | 523 | 32.9 | 73 | 17207 | 0.98 | 2.03 | Comparative example |
| 7 | 26 | 976 | 12.4 | 58 | 12102 | 1.04 | 2.00 | Comparative example |
| 8 | 9 | 550 | 29.7 | 82 | 16335 | 1.00 | 2.03 | Comparative example |
| 9 | 24 | 981 | 11.8 | 43 | 11576 | 1.01 | 2.00 | Comparative example |
| 10 | 42 | 808 | 23.5 | 80 | 18988 | 1.00 | 2.12 | Present example |
| 11 | 21 | 983 | 17.2 | 29 | 16908 | 0.99 | 2.03 | Comparative example |
| 12 | 16 | 712 | 18.3 | 61 | 13030 | 1.01 | 2.00 | Comparative example |
| 13 | 39 | 1025 | 15.8 | 61 | 16195 | 0.98 | 2.09 | Present example |
| 14 | 10 | 1201 | 7.6 | 45 | 9128 | 1.00 | 1.97 | Comparative example |
| 15 | 25 | 845 | 13.2 | 68 | 11154 | 1.02 | 2.03 | Comparative example |
| 16 | 8 | 442 | 38.9 | 92 | 17194 | 1.06 | 2.06 | Comparative example |
| 17 | 23 | 1221 | 8.8 | 32 | 10745 | 1.00 | 1.97 | Comparative example |
| 18 | 14 | 726 | 15.2 | 97 | 11035 | 1.01 | 2.03 | Comparative example |
| 19 | 26 | 573 | 34.2 | 65 | 19597 | 1.00 | 2.06 | Comparative example |
| 20 | 9 | 482 | 37.8 | 98 | 18220 | 1.05 | 2.06 | Comparative example |
| 21 | 3 | 1035 | 8.2 | 36 | 8487 | 0.99 | 1.97 | Present example |
| 22 | 51 | 642 | 31.4 | 91 | 20159 | 1.00 | 2.12 | Comparative example |
| 23 | 49 | 623 | 32.1 | 89 | 19998 | 1.03 | 2.12 | Present example |
| 24 | 56 | 631 | 31.2 | 94 | 19687 | 1.01 | 2.09 | Present example |
| 25 | 60 | 803 | 23.5 | 78 | 18871 | 0.99 | 2.09 | Present example |

TABLE 3-continued

| | | | | | | | | |
|---|---|---|---|---|---|---|---|---|
| 26 | 52 | 812 | 22.1 | 74 | 17945 | 1.00 | 2.12 | Present example |
| 27 | 48 | 1012 | 16.3 | 65 | 16496 | 1.02 | 2.12 | Present example |
| 28 | 50 | 998 | 17.4 | 61 | 17365 | 0.98 | 2.12 | Present example |
| 29 | 56 | 639 | 35.7 | 110 | 22812 | 1.02 | 2.15 | Present example |
| 30 | 65 | 768 | 30.2 | 92 | 23194 | 0.99 | 2.15 | Present example |
| 31 | 61 | 721 | 29.1 | 90 | 20981 | 1.01 | 2.12 | Present example |
| 32 | 42 | 618 | 34.3 | 89 | 21197 | 1.04 | 2.15 | Present example |
| 33 | 56 | 635 | 35.1 | 101 | 22289 | 0.99 | 2.18 | Present example |
| 34 | 68 | 652 | 35.6 | 113 | 23211 | 1.02 | 2.18 | Present example |
| 35 | 46 | 661 | 31.5 | 82 | 20822 | 1.03 | 2.12 | Present example |
| 36 | 53 | 639 | 34.8 | 99 | 22237 | 1.00 | 2.15 | Present example |
| 37 | 70 | 622 | 36.4 | 109 | 22641 | 0.99 | 2.18 | Present example |
| 38 | 38 | 645 | 33.5 | 93 | 21608 | 1.01 | 2.12 | Present example |
| 39 | 55 | 626 | 35.3 | 104 | 22098 | 1.00 | 2.15 | Present example |
| 40 | 69 | 613 | 36.9 | 118 | 22620 | 1.02 | 2.18 | Present example |

Underlined portion: Outside the scope of the invention

The invention claimed is:

1. A high strength galvanized steel sheet excellent in processability, comprising:

a component composition, by mass %, of C: 0.05% to 0.3%, Si: 0.7% to 2.7%, Mn: 0.5% to 2.8%, P: 0.1% or lower, S: 0.01% or lower, Al: 0.1% or lower, and N: 0.008% or lower, and a balance; Fe or inevitable impurities; and a microstructure containing, in terms of area ratio, ferrite phases: 30% to 90%, bainite phases: 3% to 30%, martensite phases: 5% to 40%, and retained austenite phases in a proportion of 2% or more in terms of volume fraction, wherein a proportion of the retained austenite phases adjacent to the bainite phases is 60% or more and retained austenite phases having an aspect ratio of 3 or more are present in a proportion of 30% or more;

among the martensite phases, martensite phases having an aspect ratio of 3 or more being present in a proportion of 30% or more.

2. The high strength galvanized steel sheet according to claim 1, wherein the average crystal grain diameter of the retained austenite phase is 2.0 μm or lower.

3. The high strength galvanized steel sheet according to claim 2, further comprising at least one element selected from Cr: 0.05% to 1.2%, V: 0.005% to 1.0%, and Mo: 0.005% to 0.5%, by mass %, as a component composition.

4. The high strength galvanized steel sheet according to claim 2, further comprising at least one element selected from Ti: 0.01% to 0.1%, Nb: 0.01% to 0.1%, B: 0.0003% to 0.0050%, Ni: 0.05% to 2.0%, and Cu: 0.05% to 2.0%, by mass %, as a component composition.

5. The high strength galvanized steel sheet according to claim 2, further comprising at least one element selected from Ca: 0.001% to 0.005% and REM: 0.001% to 0.005%, by mass %, as a component composition.

6. The high strength galvanized steel sheet according to claim 1, further comprising at least one element selected from Cr: 0.05% to 1.2%, V: 0.005% to 1.0%, and Mo: 0.005% to 0.5%, by mass %, as a component composition.

7. The high strength galvanized steel sheet according to claim 6, further comprising at least one element selected from Ti: 0.01% to 0.1%, Nb: 0.01% to 0.1%, B: 0.0003% to 0.0050%, Ni: 0.05% to 2.0%, and Cu: 0.05% to 2.0%, by mass %, as a component composition.

8. The high strength galvanized steel sheet according to claim 6, further comprising at least one element selected from Ca: 0.001% to 0.005% and REM: 0.001% to 0.005%, by mass %, as a component composition.

9. The high strength galvanized steel sheet according to claim 1, further comprising at least one element selected from Ti: 0.01% to 0.1%, Nb: 0.01% to 0.1%, B: 0.0003% to 0.0050%, Ni: 0.05% to 2.0%, and Cu: 0.05% to 2.0%, by mass %, as a component composition.

10. The high strength galvanized steel sheet according to claim 9, further comprising at least one element selected from Ca: 0.001% to 0.005% and REM: 0001% to 0.005%, b mass %, as a component composition.

11. The high strength galvanized steel sheet according to claim 1, further comprising at least one element selected from Ca: 0.001% to 0.005% and REM: 0.001% to 0.005%, by mass %, as a component composition.

12. The high strength galvanized steel sheet according to claim 1, wherein the galvanization is performed by galvannealing.

13. A method of manufacturing a high strength galvanized steel sheet excellent in processability, comprising: subjecting a steel slab having the component composition according to claim 1 to hot rolling, pickling, and cold rolling to form a steel sheet, heating the steel sheet to a temperature range of 650° C. or more at an average heating rate of 8° C./s or more, holding the steel sheet in a temperature range of 700 to 940° C. for 15 to 600 s, cooling the steel sheet to a temperature range of 350 to 500° C. at an average cooling rate of 10 to 200° C./s, holding the steel sheet in a temperature range of 350 to 500° C. for 30 to 300 s, and galvanizing the steel sheet.

14. The method according to claim 13, comprising galvannealing after the galvanization.

* * * * *

UNITED STATES PATENT AND TRADEMARK OFFICE

CERTIFICATE OF CORRECTION

PATENT NO. : 8,657,969 B2
APPLICATION NO. : 12/866481
DATED : February 25, 2014
INVENTOR(S) : Kawasaki et al.

It is certified that error appears in the above-identified patent and that said Letters Patent is hereby corrected as shown below:

In the Claims

In Column 20

At line 48, Claim 10, please change “b” to --by--.

Signed and Sealed this
Eleventh Day of November, 2014

Michelle K. Lee

Michelle K. Lee
*Deputy Director of the United States Patent and Trademark Office*